United States Patent [19]

Swartz

[11] 4,294,201

[45] Oct. 13, 1981

[54] INTERNAL COMBUSTION ENGINES

[76] Inventor: Robert V. Swartz, 2528 Westford Way, Mountain View, Calif. 94040

[21] Appl. No.: 9,490

[22] Filed: Feb. 5, 1979

[51] Int. Cl.[3] ..... F02B 33/04; F01L 11/00; F02B 25/12

[52] U.S. Cl. ..... 123/73 R; 123/73 PP; 123/73 AA; 123/73 AV; 123/65 VA; 123/47 R; 123/53 B; 123/47 A; 123/53 BP; 123/52 B

[58] Field of Search ..... 123/47 B, 47 A, 52 B, 123/53 B, 53 BP, 73 R, 73 A, 193 P, 73 PP, 73 AA, 73 AV, 65 VA, 73 E

[56] References Cited

U.S. PATENT DOCUMENTS

| | | | |
|---|---|---|---|
| 1,030,217 | 6/1912 | Watres et al. | 123/52 B |
| 1,139,713 | 5/1915 | Osterman | 123/52 B |
| 1,153,432 | 9/1915 | Iler et al. | 123/52 B |
| 1,518,983 | 12/1924 | Hyvernaud | 123/73 E |
| 1,645,647 | 10/1927 | Hutsell | 123/73 AA |
| 4,096,835 | 6/1978 | Lamont | 123/193 P |

FOREIGN PATENT DOCUMENTS

| | | | |
|---|---|---|---|
| 200904 | 7/1923 | United Kingdom | 123/52 B |

*Primary Examiner*—Wendell E. Burns

[57] ABSTRACT

A two-stoke cycle combustion-engine with crank-chamber compression is described, free of charging transfer passages external to the cylinder, with pumping-displacement exceeding working-displacement for responsive intake and thorough scavenging of spent-gas residue, and featuring an annular water-cooled cell, suspended from the cylinder-head by several water-conduits, and cooperating with an annular recess in the piston-head so as to form, and transversely separate, a plain working-chamber and an annular working-chamber, longitudinally scavengeable in series, bottom-to-top and top-to-bottom, respectively, with minimal loss of charge to exhaust-port, such a system of scavenging also reducing piston cooling-problems and misfiring associated with charge-dilution (in gasoline-engines operating under partial-charge conditions). In addition, a more general scavenging principle is enunciated and claimed, applicable to rear-compression and separately-scavenged two-stroke engines.

3 Claims, 1 Drawing Figure

INTERNAL COMBUSTION ENGINES

BACKGROUND AND SUMMARY

The practical objects and aspects of the invention, in a large degree, relate to avoidance of certain well-known drawbacks of engines of the Day type, exemplified by the common "two-port" and "three-port," in designing engines of comparable simplicity and compactness. Space-wise, progress in that area is the major subject of the disclosure, discussed in detail with illustrated example, which, however, makes it obvious that a principle of more general applicability has been evolved, defining a new class of two-stroke combustion-engines. The specification and appended claims reflect that situation, but in conveying the basic spirit of the invention it is believed appropriate to concentrate upon comparison of one form of my engine with Day's version, so well known commercially. Doubling the length of a gas flow path in a "return-flue" steam-boiler is analagous, perhaps, to the idea of partitioning a combustion-engine cylinder for return-flow, the longer path affording enhanced stratification of old and new gas contents. An annular partition or divider is, of course, preferred for practical reasons. This new element—not a moving-part—is referred to as a water-cell or sleeve, and its incorporation in a Day-type engine entails elongation of the piston and additional machined-surfaces, besides a commitment to water-cooling and extra gas-seals. The result, however, which seems to be novel in spite of very extensive prior-art, indicates that significant domestication of the two-stroke carbureted gasoline-engine, at least, can be achieved, probably to an extent that, for many purposes, as the automotive field, the four-stroke engine can be supplanted. The partitioning-concept embodied in the example, in a crankcase-compression context, is clearly independent of the means of supplying scavenging-material to the open-end of the modified trunk-type piston, the salient feature being the axisymmetric scavenging-flow pattern which is effected, charge-wasting associated with the Day's transverse scavenging or with poorly-stratified uniflow-scavenging being avoided. With the gasoline-engine proposed in the example, piston overheating and distortion due to uneven cooling is avoided, allowing better lubrication and extending usefulness, vane-like transfer-porting lands in the piston functioning as a heat-exchanger. Owing to position of spark-plug electrodes relative to scavenging-circuit, and pronounced stratification of cylinder-contents after compression, misfiring and rough idling with partial-charges should be drastically reduced, perhaps no worse than that of a four-stroke. Below the level of the wrist-pin at end of down-stroke, this form of my engine is similar to commercial types.

Further objects and considerations will appear, and the invention will be more fully defined and explained, as the specification proceeds with reference to the accompanying drawing, in which:

FIG. 1 is a fragmentary sectional end-elevation, with piston shown at end of power-stroke. Changes in construction from the embodiment shown in FIG. 1 as an example can be made without departing from the legitimate and intended scope of the invention as disclosed, and as expressed in the appended claims.

DETAILED DESCRIPTION

Figure 1:
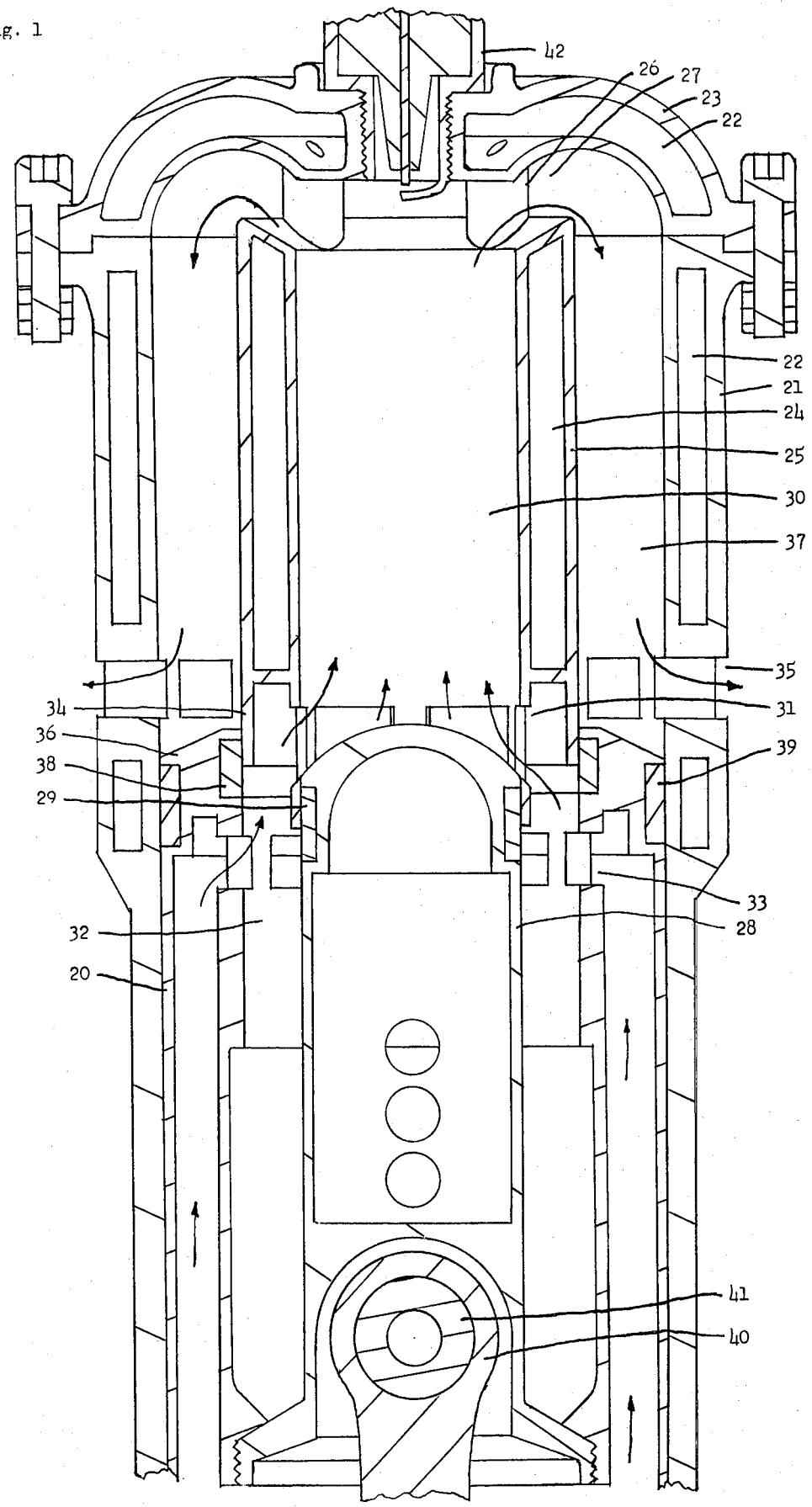

The operation of an engine utilizing various principles and elements, including those mentioned in the foregoing, will now be explained in connection with FIG. 1 and the characters of reference thereon, which form a part of this specification. Numeral 20 denotes a modified trunk-type piston, reciprocally mounted in cylinder 21, which is cooled by water-jacket 22, which latter extends into cylinder-head 23, by passages not shown. The annular water-leg 24 in stationary hollow-walled concentric sleeve 25 communicates with water-jacket 22 via four water-conduits 26, two of which are seen in elevation beyond the sectioning-plane. The annular gap 27 between the top end-face of sleeve 25 and cylinder-head 23 forms a portion of the engine's combustion-space or clearance-space, except where interrupted by water-conduits 26. A portion of the piston 20 configuration, central plunger 28 with sealing-rings 29, is slidable in sleeve 25, forming plain cylindrical working-chamber 30, and also controlling ring of transfer-porting 31 in the portion of sleeve 25 below water-leg 24. Annular recess 32 of piston 20 accommodates relative-motion of sleeve 25, and serves as a transfer-passage, communicating with crank-chamber (not shown) only when ring of transfer-porting 33 in outer wall of recess 32 is uncovered by the thin outer skirt 34 at bottom of sleeve 25. Full ring of exhaust-porting 35 in wall of cylinder 21, controlled by piston 20, allows unusually-late blow-down starting at about 82% of power-stroke, contributing to high thermal-efficiency. The ring-shaped portion of piston-head 36 surrounding sleeve 25 cooperates with the latter and also with cylinder 21 to form annular working-chamber 37, and is fitted with inner packing-rings 38 and outer seals or rings 39. Eye-end of connecting-rod 40 engages wrist-pin 41, rod 40, of course, interconnecting the engine crank-shaft (not shown) and piston 20. Simple carbureted gasoline-engine mode of operation is assumed, using spark-plug 42, the stream-lines with arrows indicating nature of scavenging-flow, the cycle of events being similar to the well-known sequence in Day's version. Centrifuge-effect, where incoming charge makes sharp turns, throws unvaporized fuel droplets against hot metal parts, providing symmetric, non-distorting cooling and cleaner combustion. Charge trapped and compressed in recess 32, on up-stroke, surges in and out of hollow plunger 28, with cooling-effect, while full area of piston 20 is effective in sucking new charge into crankcase, via reed-valve, preferably, for minimum impedance of piston, upon closing of porting-rings 31, 33, 35. By analogy with the known engine-classification term "re-entrant cylinder-head," and for descriptive purposes, piston 20 may be referred to as a re-entrant piston, being interpenetrated by a sleeve-like extension of a cylinder-head.

Having thus described my invention, what I claim as new and desire to secure by Letters Patent is:

1. An internal combustion engine of the character described comprising in combination a cylinder having adjoined at opposite ends a cylinder-head and a crankcase, a piston reciprocable in said cylinder, a scavenging-pump formed by cooperation of said piston and said crankcase, an annular recess in the head of said piston, the portion of the piston-head surrounded by said recess being referred to as a plunger, a stationary concentric sleeve suspended from said cylinder-head with transverse gas-passage-means interposed between said sleeve and said cylinder-head, a plain working-chamber formed by cooperation of said plunger with the internal cylindrical surface of said sleeve, said sleeve having a sliding fit in said recess, an annular working-chamber formed by cooperation of said piston with said cylinder and the external cylindrical surface of said sleeve, exhaust-porting in said cylinder adapted to be uncovered by said piston completing its power-stroke toward said crankcase, transfer-porting in outer wall of said recess adapted to be uncovered by the outer surface of said sleeve as said piston completes its power-stroke, whereby said recess is placed in communication with said crankcase, transfer-porting in said sleeve adapted to be uncovered by said plunger as said piston completes its power-stroke, whereby said recess communicates with said plain working-chamber, the arrangement being such that when said piston ends its power-stroke a scavenging-path is established from said crankcase into said recess, thence through said plain working-chamber, thence in various radially-outward directions through said transverse gas-passage-means, thence through said annular working-chamber to said exhaust-porting.

2. In the configuration defined by claim 1, provision in said piston of gas-passage-means whereby said recess communicates constantly with said crankcase.

3. A two-stroke cycle internal combustion engine comprising a cylinder having at opposite ends a working-space and a scavenging-pump chamber, a ported, concentric stationary sleeve partitioning said working-space into a plain working-chamber and an annular working-chamber, a hollow reentrant piston having a piston-head and an outer shell slideable in said cylinder, exhaust-porting in said cylinder adapted to be uncovered by said reentrant piston completing its power-stroke toward said scavenging-pump chamber, an annular recess interrupting said piston-head to permit cooperation with said sleeve, a central portion of said reentrant piston operating in said plain working-chamber and referred to as a plunger, transfer-porting in said sleeve adapted to be uncovered by said plunger as said reentrant piston completes its power-stroke, transverse gas passage means in said sleeve allowing constant communication of said plain working-chamber with said annular working-chamber, and transfer-passage means in said reentrant piston allowing communication of said transfer-porting with said scavenging-pump chamber as said reentrant piston completes its power-stroke.

* * * * *